US012680237B2

(12) United States Patent
Sethunath et al.

(10) Patent No.: US 12,680,237 B2
(45) **Date of Patent: *Jul. 14, 2026**

(54) ARTIFICAL TURF INFILL WITH NATURAL RUBBER GRANULES

(71) Applicant: Ten Cate Thiolon B.V., Nijverdal (NL)

(72) Inventors: Salil Sethunath, Nijverdal (NL); Niels Gerhardus Kolkman, Nijverdal (NL); Colin Young, Nijverdal (NL); Michael Rene Vogel, Nijverdal (NL); Hein Anton Heerink, Nijverdal (NL)

(73) Assignee: Ten Cate Thiolon B.V., Nijverdal (NL)

( * ) Notice: Subject to any disclaimer, the term of this patent is extended or adjusted under 35 U.S.C. 154(b) by 265 days.

This patent is subject to a terminal disclaimer.

(21) Appl. No.: 18/258,566

(22) PCT Filed: Dec. 23, 2021

(86) PCT No.: PCT/EP2021/087530

§ 371 (c)(1),
(2) Date: Jun. 21, 2023

(87) PCT Pub. No.: WO2022/136657

PCT Pub. Date: Jun. 30, 2022

(65) Prior Publication Data

US 2023/0374738 A1 Nov. 23, 2023

(30) Foreign Application Priority Data

Dec. 23, 2020 (NL) ..... 2027212

(51) Int. Cl.
*E01C 13/08* (2006.01)

(52) U.S. Cl.
CPC ..... *E01C 13/08* (2013.01)

(58) Field of Classification Search
CPC . E01C 13/08; C08L 7/00; C08L 17/00; C08L 19/02
See application file for complete search history.

(56) References Cited

U.S. PATENT DOCUMENTS 3,930,107 A * 12/1975 Yaeda ..... C08J 3/124 428/407
5,041,320 A * 8/1991 Meredith ..... E01C 13/08 428/407
6,458,300 B1 * 10/2002 Meyer de Groot ..... B29C 48/40 264/141
2019/0203425 A1 * 7/2019 Sawyer ..... E01C 13/08
(Continued)

FOREIGN PATENT DOCUMENTS

CN 1246133 A 3/2000
CN 1936187 A 3/2007
(Continued)

OTHER PUBLICATIONS

English translation of KR 102011437 B1 to Sin obtained from PE2E database (Year: 2019).*

*Primary Examiner* — Jeremy R Pierce
(74) *Attorney, Agent, or Firm* — Ipsilon USA—NLO

(57) ABSTRACT

Provided herein is a natural rubber based infill for artificial turf having biodegradable granules. The granules have a natural rubber that has been physically but not chemically modified by the addition of a quantity of filler material, and the granules have a mean size of between 0.2 and 5 mm.

19 Claims, 2 Drawing Sheets

(56) References Cited

U.S. PATENT DOCUMENTS

| | | | | |
|---|---|---|---|---|
| 2022/0042252 | A1* | 2/2022 | Sick | E01C 13/08 |
| 2023/0243110 | A1* | 8/2023 | Seifert | E01C 13/08<br>524/9 |

FOREIGN PATENT DOCUMENTS

| | | | | | |
|---|---|---|---|---|---|
| CN | 103756077 | A1 | 4/2014 | | |
| CN | 109689974 | A | 4/2019 | | |
| EP | 3336251 | A1 * | 6/2018 | E01C 13/08 | |
| EP | 3666976 | A1 | 6/2020 | | |
| GB | 2429171 | A | 2/2007 | | |
| KR | 101592143 | B1 | 2/2016 | | |
| KR | 102011437 | B1 * | 8/2019 | B29B 7/90 | |
| KR | 102093663 | B1 | 3/2020 | | |
| WO | WO-2018208150 | A1 * | 11/2018 | E01C 13/08 | |

* cited by examiner

ARTIFICAL TURF INFILL WITH NATURAL RUBBER GRANULES

The present invention relates to an infill for artificial turf systems, the infill comprising unvulcanized natural rubber. The invention further relates to a method of manufacturing infill for artificial turf systems and an artificial turf system comprising said infill.

BACKGROUND

Artificial turf systems may be used to replace natural grass or as an alternative greening for sports, aesthetic, environmental and other uses and have developed through a number of generations to their present form. In general, such systems seek to achieve the same characteristics as their natural counterparts although in certain areas these may have already been surpassed, at least in terms of predictability of behaviour.

Typical turf systems comprise a backing layer with an upper surface and an infill layer of soft and/or hard granules disposed between the fibres. The backing layer may consist of a woven fabric in which artificial grass fibres are tufted to provide pile fibres oriented in an upward position and fixed to the woven fabric by a coating typically of latex or polyurethane. Alternatively, the backing and the pile fibres can be produced simultaneously by weaving such as for a woven carpet. Here there is considerable freedom for the position of the pile fibres and the backing structure.

In many cases the turf system will contain infill particulates which are strewn between the upstanding pile fibres. These provide a combination of functions including stability of the system and sports performance characteristics. These performance characteristics will depend on the intended use but for most sports will include: rotational and linear grip; shock attenuation; vertical ball bounce; and rotational friction as decreed by the relevant sports bodies such as FIFA and World Rugby. This performance can be further supported by applying a shock pad or e-layer directly under the backing layer. One system of this type has been described in UK patent application GB2429171.

There is an ongoing effort to develop new elastomeric granules that are useful as infill. By carefully adjusting the properties of the granules that make up this infill material it is possible to further enhance the performance characteristics of the artificial turf comprising said granules. In addition, the need to develop more sustainable technology also applies for artificial turf technology. In view of this, there is a need to develop new infill materials with a minimized environmental footprint. A promising route to improve the sustainability of infill material is to recycle or upgrade a waste stream in such a manner that it is suitable for use as performance and/or support infill. Such processes can however be difficult to accurately control, due to the variability of materials offered for recycling. Furthermore, completely recyclable or degradable materials are desirable to prevent the introduction of plastics into the environment that may persist and cause pollution. The pollution caused may be the result of proliferation of micro-plastics into the environment which pose a potential health risk to human and animal health.

Micro-plastics are defined by the European Chemicals Agency (ECHA) as materials consisting of solid polymer containing particles, to which additives or other substances may have been added, and where ≥1% w/w of particles have (i) all dimensions 1 nm≤x≤5 mm, or (ii), for fibres, a length of 3 nm≤x≤15 mm and length to diameter ratio of >3. Such micron scale pieces of plastic may remain in the environment after the mechanical break-down of larger pieces of plastic that have been littered or dumped. Micro-plastics have been shown to travel up the food chain and have the potential to cause severe health problems as they tend to accumulate in the internal organs of a human or animal.

It would be desirable to provide an improved infill that alleviates at least some of the problems inherent to existing infill materials.

SUMMARY OF THE INVENTION

According to the present invention, there is provided a natural rubber based infill for artificial turf, comprising biodegradable granules, wherein the granules comprise natural rubber that has been physically but not chemically modified by the addition of a quantity of filler material, wherein the granules have a mean size of between 0.2 and 5 mm.

Natural unvulcanized rubber is a polymer that has been polymerized in nature. It may sometimes be referred to as natural latex and is primarily derived from the Hevea Brasilens or rubber tree. Polymers that occur in nature, as long as their chemical structure has not been modified, are considered inherently biodegradable in nature. The term "biodegradable" as used herein refers to a material that can be broken down naturally to re-enter the ecosystem once degraded, leaving only naturally occurring materials. This term therefore excludes petrochemical plastics that persist in the environment and cause pollution. This term and other terms referred to hereinafter, will be interpreted in the context of the EU REACH Regulation (Regulation No1907/2006 concerning the Registration, Evaluation, Authorisation and Restriction of Chemicals).

In conventional processes, natural rubber is vulcanised or otherwise cross-linked by the addition of a suitable cross-linking additive such as sulphur. The resulting rubber product is generally not considered biodegradable, since break-down under normal environmental conditions will take up to 100 years or more. Natural rubber is primarily polyisoprene and after vulcanisation is considered to be chemically modified due to the presence of cross-links between the respective polymer chains of the polyisoprene molecules. Natural rubber that has not been vulcanised can be relatively easily broken down under naturally occurring environmental conditions to microbial biomass, in a matter of a few years. The process may be accelerated by the presence of additional enzymes and other micro-organisms and under particular temperature and light conditions. This makes the presently claimed infill particularly suitable for use in situations where the ability to biodegrade is important.

In the present context, the term 'physically but not chemically modified' is to be understood in the context of REACH and is intended to denote that the natural rubber product is neither vulcanized nor chemically cross-linked. The physical modification may be understood to include mixing of the rubber with other materials as indicated below. It also includes physical transformations of the rubber or resulting mixture by shaping, moulding, pelleting or the like.

The term "granule" as used herein refers to any shaped single element of the materials and volume specified. The mean size of the granules refers to the largest dimension of a given granule and the mean is the arithmetic mean. Preferably the mean size of the granules will lie between 0.5 mm and 5 mm and preferably no particles will have dimensions greater than 10 mm. Alternatively, the granules may be defined in terms of mesh size as defined by EN 933-1 In one embodiment at least 90% by weight of the granules are retained by a 0.5 mm sieve, while at least 90% of granules will pass through a 5 mm sieve.

The granules may be of any shape, both defined and undefined, similar, different or random. The granule shape will depend on the process of manufacture and on the intended functional performance. In certain embodiments, one or a combination of any of spherical, cuboidal, cylindrical, lozenge or lenticular shapes may be chosen. EN 14955:2005 provides for standards in the classification of shapes and within this standard, the granules could be in the range A1, A2, A3, B1, B2, B3, C1, C2 & C3. Values of B2 are generally preferred as a balance between roundness and irregularity, providing resistance to compaction while avoiding excessive slippage.

The granules may be individually the same or different in size and/or shape and also in properties. In other words, the infill may comprise granules that are all formed to have the same physical properties or that have different properties e.g. due to the presence of different materials. The infill may thus be a mixture of different biodegradable granules, all of which comprise natural rubber.

In an embodiment the granule may further comprise an anti-tack agent. The anti-tack agent provides the property of tack resistance, preventing individual granules from sticking together during production, storage and/or use. The use of a natural material as anti-tack agent further ensures that the infill as a whole comprises only natural and/or biodegradable materials. The anti-tack agent may be applied as a coating or dusting to the external part of the granules or alternatively, it may be mixed and dispersed throughout the granule during the process of manufacture.

The filler material serves to physically modify the natural rubber properties. Depending on the relative amount of filler materials to natural rubber, properties such as density, modulus of elasticity, Poisson ratio, absorption, coefficient of friction etc may be adapted. The filler material may also have a significant effect on the processability of the material during production of the infill granules. The skilled person will be well aware of the different fillers that may be used and their effects on these properties. In certain situations, the filler may also act as an anti-tack agent. The anti-tack agent may also act partially as a filler.

In one embodiment, the filler material comprises inorganic natural materials. These are materials that naturally occur in nature but are not themselves bio-degradable. Examples may include minerals such as quartz or granite and other materials such as sand, chalk, talc, brick dust, carbon and/or charcoal. These materials may be provided in particulate or powder form in any suitable size or grade, ranging from inclusions that are slightly smaller in size than the granules to fine powders of nano or micron scale. The skilled person will be well aware of the alternative filler materials that may be considered for this function. For the purpose of the present invention, it is again emphasised that the presence of such inorganic natural materials in the granule does not change the fact that the granule as a whole is considered to be 'biodegradable'.

The filler material may additionally or alternatively comprise organic natural materials, such as coir fibre, wood chip, cork, corn, coir pith, hemp, or plant waste in powder, particle or fibre form. These materials have the advantage of being obtainable through recycling or reclaiming processes from various readily available waste products. A further advantage is the absence of micro-plastics in such natural organic materials, whereby the infill as a whole can be used without fear of micro-plastics entering the environment. Other advantages of coir pith, cork, corn and other similar natural materials are their resistance to aging and tearing, resilience to adverse weather conditions, and being sufficiently dense to provide a stabilising weight to the infill. Furthermore, these materials do not absorb heat as much as polymeric infill and thereby provide a cooler turf system in use.

According to a further aspect, the granules may also comprise a binding agent, which will also be a naturally occurring material. This may preferably be a biodegradable material such as plant starch. This again provides the advantages of being sourceable from waste products and being devoid of micro-plastics. The natural rubber is itself a binding agent in that it serves to bind the filler to form a stable granule. In the present context, reference to a binding agent is thus directed to binding agents other than natural rubber. The skilled person will be familiar with other possible binding agents, which may include gums, oils, proteins, starches, resins, waxes and the like.

As indicated above, the granule may comprise various relative amounts of natural rubber, filler material and further optional components as determined by the required properties. In one embodiment, the granule comprises from 10 to 80 wt % of filler and from 10 to 50 wt % natural rubber, more preferably from 20 wt % to 40 wt % natural rubber.

In certain embodiments, the granules may comprise inclusions, having a size of between 10% and 90% of the granule. In this context 'inclusion' is used to denote a particulate or body that is large compared to the granule i.e. smaller than the granule but of a similar order of magnitude. The inclusions may be formed of the same material as the filler materials and their volume may be taken into account together with that of the filler material. In some embodiments, there may be precisely one inclusion per granule.

In particular, the inclusions may be relevant to the method of manufacture of the granules. They may be mixed into the precursor material from which the granule is formed e.g. by extrusion. The mixture can take place by conventional mixing methods e.g. using screws and hoppers to deliver the respective components and may take place prior to or during an extrusion process. Alternatively, each granule may comprises a layer of natural rubber coated onto one or more surfaces of an inclusion, forming a core of the granule, e.g. by a dipping process or the like.

As indicated above, the anti-tack agent renders the granules tack resistant, preventing individual granules from sticking together during production, storage and/or use. In preferred cases, the resulting granules should be loose and free flowing at all temperatures where use is required, in particular between −10 C and 80 C, since outdoor sports surfaces can readily reach since elevated temperatures when exposed to the sun. It is however contemplated that usable infill for indoor or covered purposes could be adequately tack resistant if tack resistant to temperatures of 50 C.

In this context, tack resistant may be defined to comprise granules that are not tacky at temperatures below 50 C, more preferable below 60 C, more preferably below 70 C and most preferably below 80 C. Tackiness for this purpose is assessed by heating a sample in a dish (about 5 mm layer thickness) overnight in an oven at the relevant temperature. The sample is subsequently cooled down and the granules are assessed. If the granules are still loose granules, or can be set free by slight agitation, then the sample is judged as not tacky. If, on the other hand, the granules form a cake, this is judged as tacky or not tack resistant. The highest temperature where the granules remain non-tacky is denoted as the tackiness temperature.

According to another aspect of the invention, the granule is preferably resilient, with a Shore A hardness of between 20 and 90, or between 30 and 70, preferably between 40 and 60 optionally around 50. The skilled person will be well aware of how to achieve the desired ranges by the addition of the filler materials mentioned above. In this context, it is noted that the resilience of natural rubber is distinct from that of vulcanised rubber, where it is the nature of the cross-linking that can significantly influence the rubber performance. In general, natural rubber without any filler material will remain liquid or viscous and hardness cannot be measured. As filler material is added, the hardness will increase. Ideally, the granules will have a hardness close to existing synthetic rubber granulate used for infill. Nevertheless, due to the constraints of using unvulcanised rubber, requiring greater quantities of filler material, higher hardness values may be expected.

In the present context, it is understood that resilient refers to the material property that the material can be deformed upon application of an external force and will spontaneously return to its original shape when the force is removed. This behaviour can be fully elastic by which it is meant that the material returns to its original shape quickly when the force is removed, and that the material substantially returns all energy which was needed to deform the material. However, preferably it is viscoelastic by which it is meant that the material only slowly returns to its original shape and that it does not give back all the energy needed to deform the material. In an embodiment, the granules exhibit an energy restitution that is less than that of SBR, preferably less than 40% measured on an equipment turf system according to FIFA method 13 (Handbook of Test Methods October 2015 Edition—Version 3.1 16/03/2020).

The present invention also relates to an artificial turf system comprising a quantity of infill as described above or hereinafter. It will be understood that the resulting system on which sport may be practiced is dependent not only on the infill but also on other factors such as the artificial turf itself and any underlay, shock pad or substrate beneath the turf. Additional infill materials may also be combined and mixed with the natural rubber infill.

In and embodiment, the artificial turf system comprises a backing layer and artificial grass blades upstanding from the backing layer, with the infill distributed between the artificial grass blades.

In a further embodiment, the system may further comprises additional infill in the form of a quantity of particulates of a natural material that does not comprise natural rubber. The additional infill may be provided beneath the natural rubber infill or may be intimately mixed with the natural rubber infill. The particulates may be inorganic natural materials such as sand, stone, quartz, gravel or the like. The particulates may additionally or alternatively comprise organic natural materials, such as coir fibre, wood chip, cork, kernels, corn, coir pith, hemp and the like. These materials may be provide in any suitable size or grade, depending on whether they are intended to form a layer beneath the natural rubber infill or are intended to be mixed with the natural rubber infill.

The invention also relates to a method of manufacturing an infill granule for artificial turf comprising: cold forming of a precursor from a composition comprising natural rubber and a filler material; dividing the precursor into granules; and providing the granules with an anti-tack agent, wherein the method is carried out without chemical modification of the natural rubber by cross-linking or otherwise. In the present context, cold forming is intended to denote a process that is carried out at room temperature without requiring heating of the natural rubber (latex) as is usually the case in extrusion processes involving vulcanised or cross-linked rubbers.

In one embodiment, the granules are provided with the anti-tack agent prior to dividing the precursor, this may be achieved by providing it as a film, coating or dusting onto the precursor during the cold forming process. In this context, the anti-tack agent is distinguished from the filler in that its primary function is to prevent adherence between granules rather than to enhance the structure of the granule itself. The anti-tack agent may thus form a layer, without becoming mixed or fully impregnated with the natural rubber. In certain embodiments, the composition of the granule comprises 20% to 60% of filler, 20% to 60% natural rubber, and 10% to 30% an anti-tack agent. In a preferred embodiment, these ratios may be around 40/40/20 with a variation of +/−5%.

In another embodiment, the method includes treating the granule with an anti-ageing step such as treatment with anti-oxidants or exposure to UV light.

Various cold forming processes may be contemplated. In one embodiment, the cold forming of the precursor comprises cold extrusion into sheets or filaments. In another alternative embodiment, the cold forming of the precursor comprises coating a core, e.g. by a dipping process. The core may comprises a natural fibre rope and dividing the precursor into granules may then comprise cutting the coated rope into short segments. The rope will remain within the granule as an inclusion as defined above. The natural fibre rope may be coir rope, sisal rope, or jute rope. In this context rope is intended to include thread or filaments either spun, plied, braided or otherwise. An alternative cold forming process is pelletizing, whereby the mixed ingredients are delivered to a pelletizing machine. The skilled person is familiar with the pelletizing process in the context of animal feed and the like.

Various hot forming processes may be contemplated. In one embodiment, the hot forming of the precursor comprises hot extrusion into sheets or filaments.

Further aspects of the present invention are set out in the accompanying independent and dependent claims. Combinations of features from the dependent claims and independent claims may be combined in any appropriate combination and not merely as explicitly set out in the claims.

BRIEF DESCRIPTION OF THE DRAWINGS

The features and advantages of the invention will be better appreciated upon reference to the figures, which illustrate an exemplary embodiment.

DETAILED DESCRIPTION OF THE EMBODIMENTS

Figure 1:
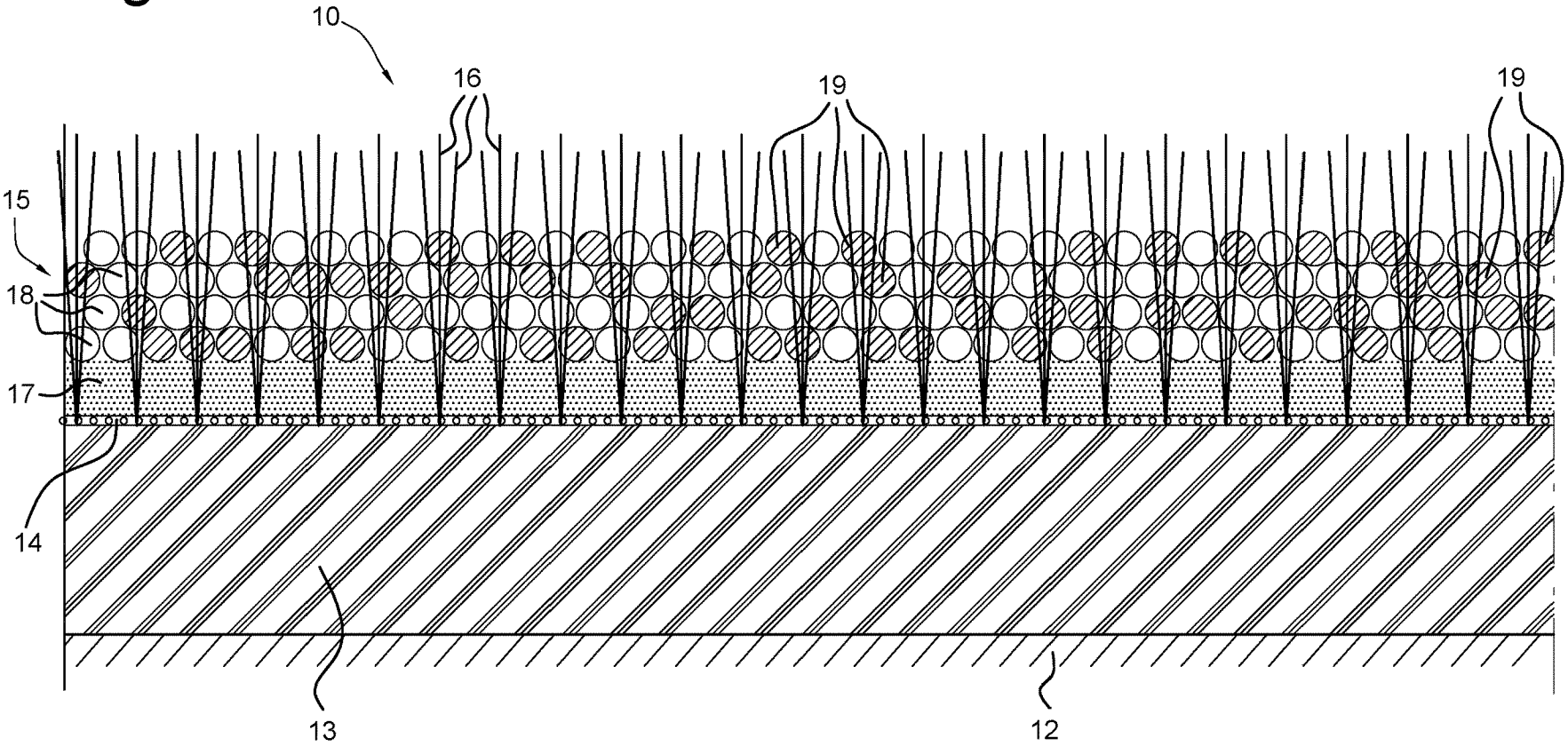
FIG. 1 shows a cross-section through an artificial turf system 10 according to an embodiment of the present invention.

The artificial turf system 10 as shown in FIG. 1, comprises a stabilised sub-base 12, a resilient layer 13, a woven artificial turf substrate 14 having upstanding pile fibres 16, a stabilising infill layer 17 of sand, and a performance infill layer 15 of particulates 18 and natural rubber based granules 19. In the illustrated embodiment, the particulates 18 and granules 19 are of the same size and shape with a mean size of 4 mm. The particulates 18 are smooth graded river gravel, while the granules 19 are a mixture of natural rubber and filler material manufactured according to the process of Example 1 as given below.

Figure 2:
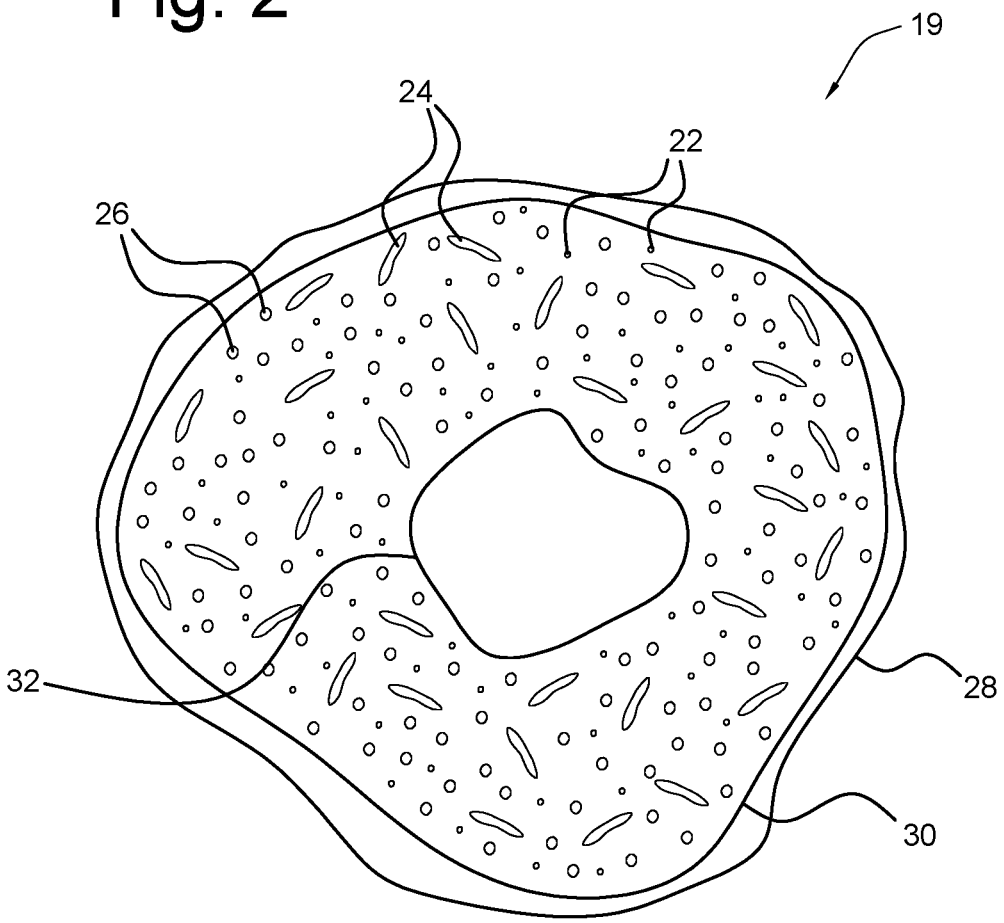
FIG. 2 shows a schematic cross-section through a granule according to the present invention.

FIG. 2 shows a schematic cross-section through a granule 19 of FIG. 1. The granule 19 is rounded in the range C2 (C1 to C3) according to EN 14955:2005 and of mean size 3 mm. It comprises around 30% by weight of latex rubber 22, which forms a matrix around coir fibres 24 of and wood powder 26. An outer surface 30 of the granule 19 is covered with a dusting of chalk 28. At the centre of the granule 19 is an inclusion 32 of 1.5 mm graded stone onto which the rubber is coated.

It will be understood that the above is merely exemplary and the granules 19 may have a formulation and structure according to any embodiment of the invention disclosed herein.

Furthermore, terms for components used herein should be given a broad interpretation that also encompasses equivalent functions and features. Descriptive terms should also be given the broadest possible interpretation; e.g. the term "comprising" as used in this specification means "consisting at least in part of" such that interpreting each statement in this specification that includes the term "comprising", features other than that or those prefaced by the term may also be present. Related terms such as "comprise" and "comprises" are to be interpreted in the same manner. The present description refers to embodiments with particular combinations of features, however, it is envisaged that further combinations and cross-combinations of compatible features between embodiments will be possible.

Example 1

An exemplary natural rubber based infill was produced and tested as follows:

Equal amounts by weight of raw liquid latex, coir fibres (pulverised into a powder<0.2 mm diameter) and wood (pulverised into a powder<0.2 mm diameter) were compounded together. The raw latex contained around 30% water. After mixing for around 3 hours coagulation was initiated by addition of formic acid (diluted 1:20 ratio). The mixture was formed into sheets of around 3 mm thickness using a press. The sheets had excess water removed and were subsequently dried ambiently for 2 days.

The sheets were then mechanically shredded with the addition of a chalk anti-tack to produce granules having sizes in the range of 0.5 mm to 5 mm and shapes in the A2 and A3 ranges. The granules exhibited excellent elasticity with a similar feel to existing polymeric infills. Note: cryogenic shredding was also found to work.

A test area of artificial turf was prepared using a depth of 25 mm of the granules distributed into an artificial turf substrate of 50 mm pile height with 10 mm of a stabilising sand layer. The artificial turf was tested according to FIFA Handbook of Test Methods October 2015 Edition—Version 3.1 16/03/2020, with the following results.

| Key Property | Result | Target Range | Comment |
|---|---|---|---|
| Bulk Density (kg/m3) | 0.349 | 0.2 to 0.8 | Can be flexible |
| Size (mm) | 0.5 to 4.0 | 1 to 2.5 | Can be flexible |
| Shape | A2 | flexible | Can be flexible |
| Shore Hardness | 54 | <80 | — |
| Wear (%) | 16 | <30 | Can be flexible but target result better than cork granules |

-continued

| Key Property | Result | Target Range | Comment |
|---|---|---|---|
| Shock Absorption (%) | 56.0 | >50 | 50 mm reference turf with 10 mm sand infill and 25 mm performance infill |
| Deformation (mm) | 7.5 | <10 | |
| Energy Restitution (%) | 36 | <40 | |
| Ball Rebound (m) | 0.76 | <0.95 | |
| Rot. Resistance (Nm) | 35 | >30 & <45 | |

Further testing indicated a Shore A hardness of 54 and a resistance to both freezing and water over extended periods.

Example 2

In a second prophetic example, natural latex (10%), coir fibres pulverised into a powder<0.2 mm diameter (20%), wood pulverised into a powder<0.2 mm diameter (20%) and calcium carbonate powder (50%) were mixed together. After mixing, the materials were pelletised to form pellets (cylindrical granules) of 2 mm diameter and approximately 8 mm length (further cut down to 2 mm).

The granules exhibited excellent elasticity with a similar feel to existing polymeric infills.

The invention claimed is:

1. A natural rubber based infill for artificial turf, comprising bio-degradable granules, wherein the granules comprise natural rubber that has been physically but not chemically modified by the addition of a quantity of filler material and an anti-tack agent, wherein the filler material comprises organic natural material, the anti-tack agent consists of a natural absorbent powder, and all components of the granule are naturally occurring materials such that the granule can be broken down naturally and wherein the granules have a mean size of between 0.2 mm and 5 mm.

2. The infill according to claim 1 wherein the filler material comprises inorganic natural materials.

3. The infill according to claim 1, wherein the granules further comprise a binding agent.

4. The infill according to claim 3, wherein the binding agent comprises plant starch.

5. The infill according to claim 1, wherein the granules comprise from 40 to 80 wt % of filler and from 10 to 40 wt % rubber.

6. The infill according to claim 1, wherein the granules comprise inclusions of organic natural filler material, having a size of between 10% and 90% of the granule.

7. The infill according to claim 6, wherein each granule comprises a layer of natural rubber coated onto one or more surfaces of an inclusion.

8. The infill according to claim 1, wherein the anti-tack agent is mixed and dispersed in the granule.

9. The infill according to claim 1, wherein the granules are loose and free flowing at temperatures between −10° C. and 80° C.

10. The infill according to claim 1, wherein the anti-tack agent is sand, chalk, quartz, brick dust, charcoal, or corn starch.

11. The infill according to claim 1, wherein the infill comprises 20% to 60% of filler, 20% to 40% natural rubber, and 10% to 30% anti-tack agent.

12. The infill according to claim 1, wherein the organic natural material is coir fibre, wood chip, cork, corn, coir pith, hemp, starch or plant waste.

13. The infill according to claim 1, wherein the granule has a Shore A hardness of between 40 and 90.

14. An artificial turf system comprising a quantity of the infill according to claim 1.

15. The artificial turf system according to claim 14, wherein the infill further comprises a quantity of particulates of a natural material that does not comprise natural rubber.

16. A method of manufacturing the infill granule for artificial turf according to claim 1, comprising:

cold forming of a precursor from a composition comprising natural rubber and a filler material, wherein the filler material comprises organic natural material;

dividing the precursor into granules; and providing the granules with an anti-tack agent, wherein the method is carried out without chemical modification of the natural rubber by cross-linking or otherwise.

17. The method according to claim 16, further comprising treating the granule with an anti-ageing step.

18. The method according to claim 16, wherein the cold forming of the precursor comprises cold extrusion into sheets or filaments or coating a core.

19. The method according to claim 18, wherein the cold forming comprises extrusion through a pelletizing machine to form cylindrical pellets.

* * * * *